US005301612A

United States Patent [19]

Stahl et al.

[11] Patent Number: 5,301,612

[45] Date of Patent: Apr. 12, 1994

[54] CARBON-ASSISTED FLYER PLATES

[75] Inventors: David B. Stahl, Los Alamos; Dennis L. Paisley, Santa Fe, both of N. Mex.

[73] Assignee: The United States of America as represented by the United States Department of Energy, Washington, D.C.

[21] Appl. No.: 68,032

[22] Filed: May 28, 1993

[51] Int. Cl.[5] ..... F42C 19/08; F42B 3/113

[52] U.S. Cl. ..... 102/201

[58] Field of Search ..... 102/201, 202.5

[56] References Cited

U.S. PATENT DOCUMENTS 3,812,783 5/1974 Yang et al. ..... 102/201
5,029,528 7/1991 Paisley ..... 102/201
5,046,423 9/1991 Paisley ..... 102/201

*Primary Examiner*—Ian J. Lobo
*Attorney, Agent, or Firm*—Milton D. Wyrick; Paul D. Gaetjens; William R. Moser

[57] ABSTRACT

A laser driven flyer plate utilizing an optical fiber connected to a laser. The end of the optical fiber has a layer of carbon and a metal layer deposited onto it. The carbon layer provides the laser induced plasma which is superior to the plasma produced from most metals. The carbon layer plasma is capable of providing a flatter flyer plate, converting more of the laser energy to driving plasma, promoting a higher flyer plate acceleration, and providing a more uniform pulse behind the plate. In another embodiment, the laser is in optical communication with a substrate onto which a layer of carbon and a layer of metal have been deposited.

8 Claims, 2 Drawing Sheets

CARBON-ASSISTED FLYER PLATES

The invention is a result of a contract with the Department of Energy (Contract No. W-7405-ENG-36).

BACKGROUND OF THE INVENTION

The present invention generally relates to flyer plates and, more specifically, to laser initiated flyer plates having multiple layers of material.

Flyer plates have been used for detonating explosives since their invention in the late 1960's. Originally, these flyer plates were electrically operated, utilizing an electrically produced plasma to accelerate the plate. It was subsequently discovered, after development of the laser, that laser induced plasmas could be used for plate acceleration.

Current laser initiated explosives or energetic materials operate by either of two methods: thermal runaway, or exploding a metal film to generate a high temperature in a manner similar to an exploding bridgewire. The first of these, thermal runaway, is a slow process requiring a period ranging from several hundred microseconds to several milliseconds to attain plate acceleration. Additionally, thermal runaway requires the addition of undesirable additives to the energetic material in order to reduce energy and thermal requirements to a practical level.

The second, the exploding metal film, is effective for detonation of low density ($\approx$0.5 Theoretical Maximum Density-TMD) secondary explosives, but is not effective to produce detonation at reasonable energies for high density ($=\approx$0.9 TMD) explosives.

There is currently significant interest in inertial confinement fusion, where large amounts of energy are directed at a sphere of fuel. Although laser beams are now being used in testing, it is conceivable that multiple flyer plates could be launched at the fuel sphere, or that an imploding flyer plate could be on the fuel sphere. The flyer plate may reduce or eliminate the pre-heat problem with large, high power lasers. The invention also finds application in one-dimensional impact of metals or other materials used in shock physics and high strain rate materials research.

The basic prior process for accelerating foils by laser beams involves focusing a laser beam on a free-standing foil in order to convert a portion of the thickness of the foil into a plasma. This plasma will drive a segment of the foil toward a target. Conventional laser interaction with metals produces penetration of the laser beam into the metal of only a few hundred angstroms. The energy deposited in the metal by the laser results in formation of a plasma within a few ns, which plasma drives a flyer plate toward a target.

This process, although effective in settings where laser, focusing lens and free standing foil can all be located in reasonably close proximity is not amenable to use in harsh environments, where equipment such as lasers would not be suitable. It is also not suitable for all geometries, as when sufficient access to the foil is not possible. Additionally, when the laser is used in outside or unsecured applications, it is susceptible to damage and perhaps even false initiation. These problems were overcome by the previous invention which is disclosed in U.S. Pat. No. 5,029,528, issued Jul. 9, 1991, entitled Fiber Optic Mounted Laser Driven Flyer Plates. This patent teaches the launching of flyer plates directly from the end of optical fibers. This allows the plate to be launched from positions inaccessible to and remote from the laser light source.

These prior laser initiated flyer plate systems were based primarily on either a single layer of metal, or multiple layers of metal, dielectric, and metal, on a substrate or optical fiber end. While all are effective, there are significant differences in plate velocity and kinetic energy.

The present invention improves upon these prior flyer plate systems by the introduction of a layer of carbon between the substrate or fiber optic end and the flyer plate. This layer of carbon provides several benefits which allow the launched plates to attain higher terminal velocities than was achieved with the prior art.

It is therefore an object of the present invention to provide laser initiated flyer plates which are capable of attaining high terminal velocities.

It is another object of the present invention to provide laser initiated flyer plates in which the pressure of the driving plasma is equalized across the spatial extent of the flyer plate, creating a flatter plate.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention comprises a laser with an optical fiber having proximal and distal ends, having its proximal end connected to the laser. A layer of carbon is deposited onto the distal end of the optical fiber, and a metal layer is deposited onto the layer of carbon.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention provides apparatus for the improved launching of flyer plates either from the end of an optical fiber, or from a substrate, in which a thin layer of carbon is deposited onto the fiber end or substrate and the metal layer is deposited over the carbon layer. This employment of a layer of carbon between fiber end or substrate, and the metal layer provides significant benefits for a launched plate.

Figure 1:
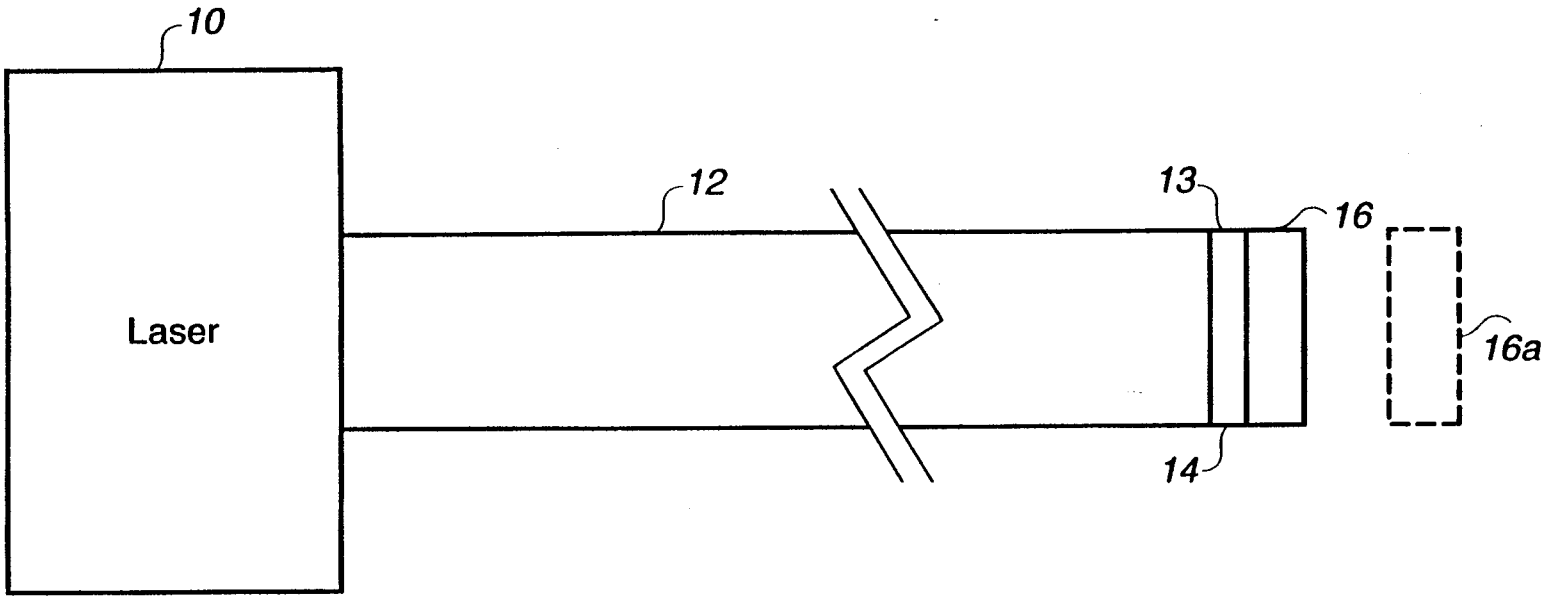
FIG. 1 is a cross-sectional view of an embodiment of the present invention in which an optical fiber has its proximal end connected to a laser and has carbon and metallic layers deposited on its distal end.

The invention can be most easily understood through reference to FIG. 1. Here, a cross-sectional view of optical fiber 12, connected to laser 10, is illustrated. At end 13 of optical fiber 12, carbon layer 14 is deposited to a thickness of approximately 2 μm. Carbon layer 14 can be conveniently deposited by way of electron beaming.

After carbon layer 14 is deposited, metal layer 16 is deposited over carbon layer 14. The thickness of metal layer 16 can be adjusted according to a particular application. Many different metals could be employed, although aluminum yields excellent results. Metal layer 16 can be deposited onto carbon layer 14 by way of physical vapor deposition.

Most prior art laser initiated flyer plate systems generally coupled laser energy through a lens and an optically transparent substrate to a conventional foil. The laser energy transforms the foil on which it is incident to a plasma, creating high temperature and pressure between the foil and the substrate. When the pressure is sufficiently great, a plug of the foil will break free and be launched toward a target.

Figure 2:
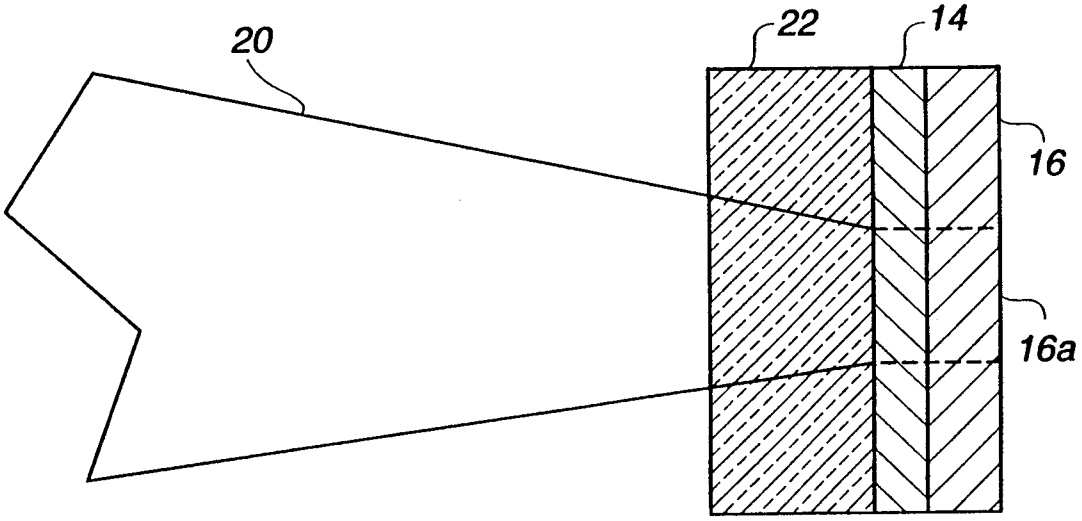
FIG. 2 is a cross-sectional view of another embodiment of the present invention in which a substrate is illuminated by a laser beam, and the substrate has layers of carbon and metal deposited onto it.

FIG. 2 illustrates another embodiment of the present invention in which laser beam 20 is focussed onto substrate 22. Deposited onto substrate 22 are carbon layer 14 and metal layer 16 as in the previous embodiment. This embodiment is particularly useful in laboratory experiments.

The present invention accomplishes the same functions in a much simpler and more versatile manner as shown in FIG. 1. With carbon layer 14 applied directly onto end 13 of optical fiber 12 or onto substrate 22, and metal layer 16 applied over carbon layer 14, laser 10 will create a plasma from carbon layer 14, and flyer plate 16a will be launched toward a target. As there is no requirement for a coupling lens or for a transparent substrate, the present invention can be used in applications which are remote from laser 10.

For this to occur, all that is necessary is that laser 10 be capable of outputting approximately 20–300 mJ in pulse durations of approximately 5–30 ns, so that approximately 0.75–4.0 $GW/cm^2$ is delivered at the interface between end 13 of optical fiber 12, and carbon layer 14, or between substrate 22 and carbon layer 14. In a few ns, this will create a plasma of a portion of carbon layer 14, resulting in a pressure of approximately 5–20 Kbar or greater being exerted on metal layer 16. This pressure causes metal layer 16 to yield, and flyer plate 16a to be launched toward a target (not shown).

The insertion of carbon layer 14 provides several major functions which are beneficial to the launch of flyer plate 16a from metal layer 16. The first is that the carbon plasma created by laser 10 has a sound speed higher than most metals, allowing it to equalize pressure gradients across the diameter of the flyer plate 16a more rapidly than a metal plasma. Another function is that carbon layer 14 converts more of the energy from laser 10 into a plasma than most metals because of the low reflection/adsorption ratio of carbon. Additionally, the plasma created from carbon layer 14 is light, and expands more rapidly in all directions than most metals, allowing higher acceleration.

Finally, the higher expansion velocity of the carbon plasma permits a more uniform pressure pulse both spatially, behind flyer plate 16a, and also along the vector of the velocity of flyer plate 16a.

Testing has verified the efficacy of the use of carbon layer 14. In launchings of flyer plates 16a using carbon layer 14 in accordance with the present invention, flyer plate 16a quickly accelerated to a terminal velocity of approximately 3 Km/sec. With the launch of flyer plates lacking carbon layer 14, a terminal velocity of only approximately 2 Km/sec was achieved after a significantly longer acceleration period.

The foregoing description of the preferred embodiments of the invention have been presented for purposes of illustration and description. They are not intended to be exhaustive or to limit the invention to the precise form disclosed, and obviously many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A laser driven flyer plate comprising:
   a laser;
   an optical fiber having proximal and distal ends, said proximal end being connected to said laser;
   a layer of carbon deposited onto said distal end of said optical fiber; and
   a metal layer deposited onto said layer of carbon.

2. The laser driven flyer plate as described in claim 1, wherein said metal layer comprises aluminum.

3. The laser driven flyer plate as described in claim 1, wherein said laser has an output power of between 20–300 mJ in pulse durations of approximately 5–30 nsec.

4. The laser driven flyer plate as described in claim 1, wherein said metal layer is deposited on said layer of carbon by physical vapor deposition.

5. A laser driven flyer plate comprising:
   a laser;
   a substrate in optical communication with said laser;
   a layer of carbon deposited onto said substrate; and
   a metal layer deposited onto said layer of carbon.

6. The laser driven flyer plate as described in claim 5, wherein said metal layer comprises aluminum.

7. The laser driven flyer plate as described in claim 5, wherein said laser has an output power of between 20–300 mJ in pulse durations of approximately 5–30 nsec.

8. The laser driven flyer plate as described in claim 5, wherein said metal layer is deposited onto said layer of carbon by physical vapor deposition.

* * * * *